United States Patent [19]

Krooss

[11] Patent Number: 4,961,071

[45] Date of Patent: Oct. 2, 1990

[54] APPARATUS FOR RECEIPT AND DISPLAY OF RASTER SCAN IMAGERY SIGNALS IN RELOCATABLE WINDOWS ON A VIDEO MONITOR

[76] Inventor: John R. Krooss, 750 Linden Ave., Los Altos, Calif. 94022

[21] Appl. No.: 249,646

[22] Filed: Sep. 23, 1988

[51] Int. Cl.[5] ..... G09G 1/16

[52] U.S. Cl. ..... 340/721; 340/814

[58] Field of Search ..... 340/721, 798, 799, 724, 340/814; 364/521, 518

[56] References Cited

U.S. PATENT DOCUMENTS

| | | | |
|---|---|---|---|
| 4,094,000 | 6/1978 | Brudevold | 340/799 |
| 4,197,590 | 4/1980 | Sukonick et al. | 364/900 |
| 4,258,361 | 3/1981 | Hydes et al. | 340/721 |
| 4,414,628 | 11/1983 | Ahuja et al. | 364/200 |
| 4,442,495 | 4/1984 | Sukonick | 364/521 |
| 4,533,910 | 8/1985 | Sukonick et al. | 340/721 |
| 4,542,376 | 9/1985 | Bass et al. | 340/724 |
| 4,555,775 | 11/1985 | Pike | 364/900 |
| 4,618,858 | 10/1986 | Belch | 340/724 |
| 4,623,915 | 11/1986 | Bolger | 358/22 |
| 4,651,146 | 3/1987 | Lucash et al. | 340/721 |
| 4,653,020 | 3/1987 | Cheselka et al. | 364/900 |
| 4,663,615 | 5/1987 | Hernandez et al. | 340/721 |
| 4,670,752 | 6/1987 | Marcoux | 340/721 |
| 4,692,757 | 9/1987 | Tshuhara et al. | 340/721 |
| 4,694,288 | 9/1987 | Harada | 340/721 |
| 4,710,761 | 12/1987 | Kapur et al. | 340/721 |

*Primary Examiner*—Alvin E. Oberley

*Attorney, Agent, or Firm*—Roberts and Quiogue

[57] ABSTRACT

An interface and memory system is disclosed which receives a digital raster scan image from an external source and displays this image as an inset window on a video monitor display. The input image is asynchronous with respect to the display refresh. The pipeline dual memory system is composed of update and display buffers. If the vertical rate of the input signal is greater than the vertical rate of the display refresh, the update buffer copies its entire contents into the display buffer every time the input signal completes a frame update. If the vertical rate of the input signal is less than the vertical rate of the display refresh, the copy operation is initiated just after the start of the active portion of the input frame at a vertical position equal to the top line of the input window. A continuous display is provided because no interaction between input, copy and display refresh operations is possible.

33 Claims, 9 Drawing Sheets

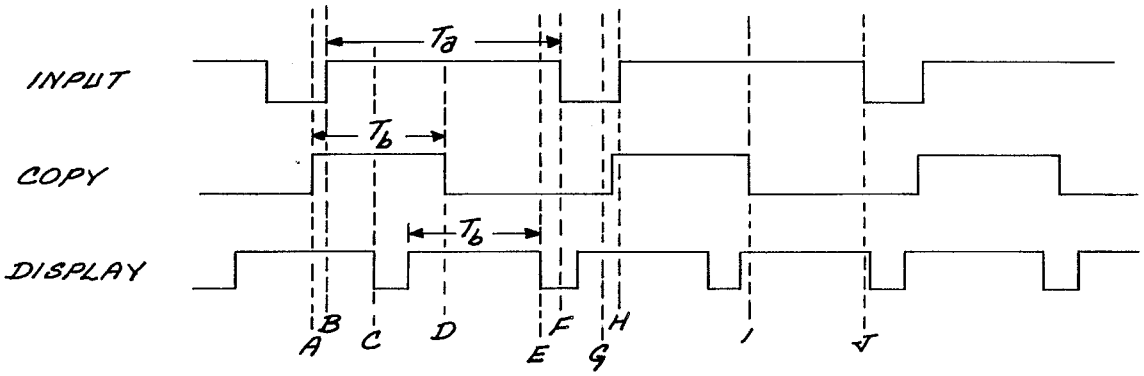
FIG.4A
FIG.4B
FIG.4C
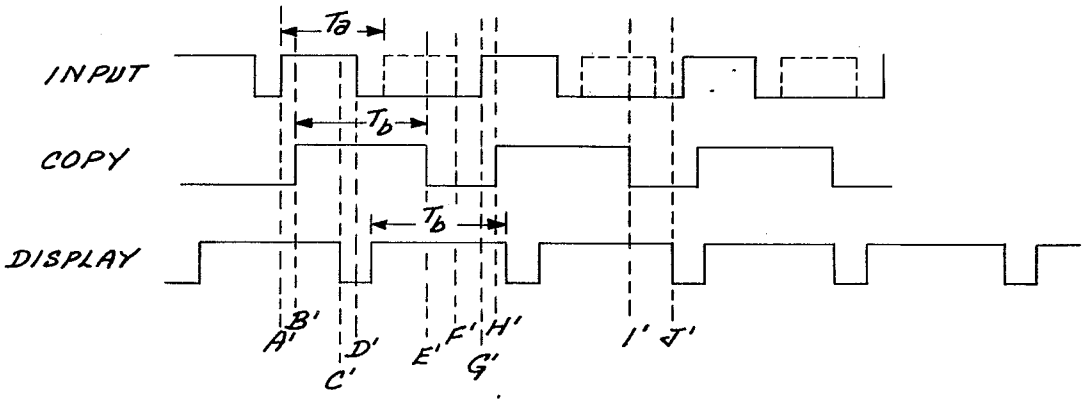
FIG.4D
FIG.4E
FIG.4F

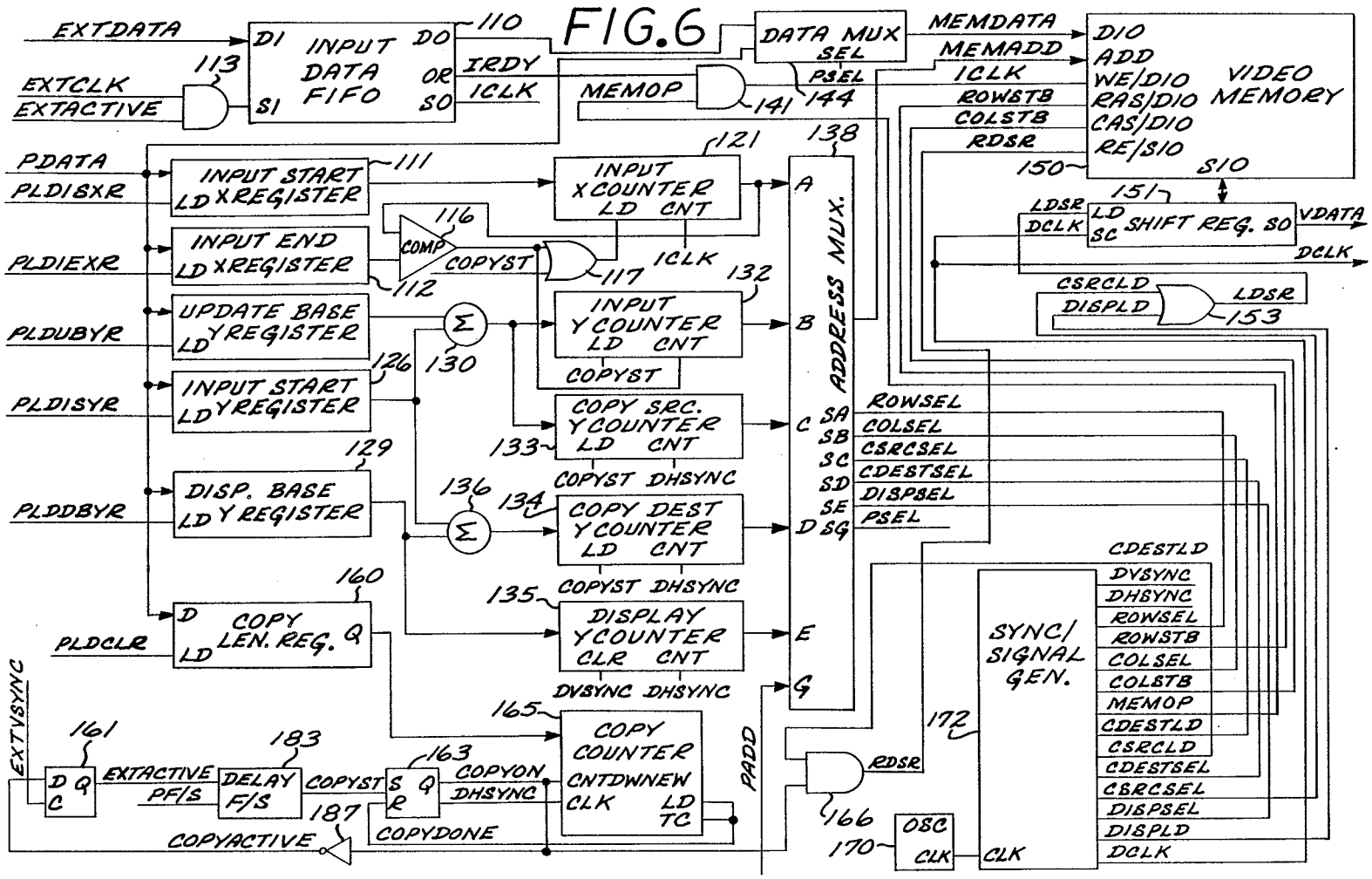
FIG.6
VIDEO MEMORY
DIO
ADD
WE/DIO
RAS/DIO
CAS/DIO
RE/SIO
SIO
MEMDATA
MEMADD
ICLK
ROWSTB
COLSTB
RDSR
150
151
SHIFT REG.
SO
VDATA
DCLK
LD
SC
LDSR
DCLK
CSRCLD
DISPLD
153
SYNC/ SIGNAL GEN.
CDESTLD
DVSYNC
DHSYNC
ROWSEL
ROWSTB
COLSEL
COLSTB
MEMOP
CDESTLD
CSRCLD
CDESTSEL
CSRCSEL
DISPSEL
DISPLD
DCLK
CLK
172
OSC
CLK
170
166
RDSR
DATA MUX
SEL
PSEL
141
144
138
ADDRESS MUX.
ROWSEL
COLSEL
CSRCSEL
CDESTSEL
DISPSEL
PSEL
A
B
C
D
E
G
SA
SB
SC
SD
SE
SG
PADD
MEMOP
121
INPUT X COUNTER
LD
CNT
ICLK
117
132
INPUT Y COUNTER
LD
CNT
COPYST
COPY SRC. Y COUNTER
LD
CNT
COPYST
DHSYNC
COPY DEST Y COUNTER
LD
CNT
COPYST
DHSYNC
DISPLAY Y COUNTER
CLR
CNT
DVSYNC
DHSYNC
COPY COUNTER
CNTDWNEW
CLK
LD
TC
110
IRDY
ICLK
DO
OR
SO
INPUT DATA FIFO
DI
SI
113
EXTDATA
EXTCLK
EXTACTIVE
116
COMP
COPYST
112
111
INPUT START LD X REGISTER
INPUT END LD X REGISTER
UPDATE BASE LD Y REGISTER
INPUT START LD Y REGISTER
DISP. BASE LD Y REGISTER
COPY LEN. REG.
D
LD
Q
130
133
134
136
135
165
COPYON
DHSYNC
163
S
Q
R
COPYDONE
COPYST
187
183
DELAY
F/S
EXTACTIVE
PF/S
161
D
Q
C
PDATA
PLDISXR
PLDIEXR
PLDUBYR
PLDISYR
PLDDBYR
PLDCLR
EXTVSYNC
COPYACTIVE

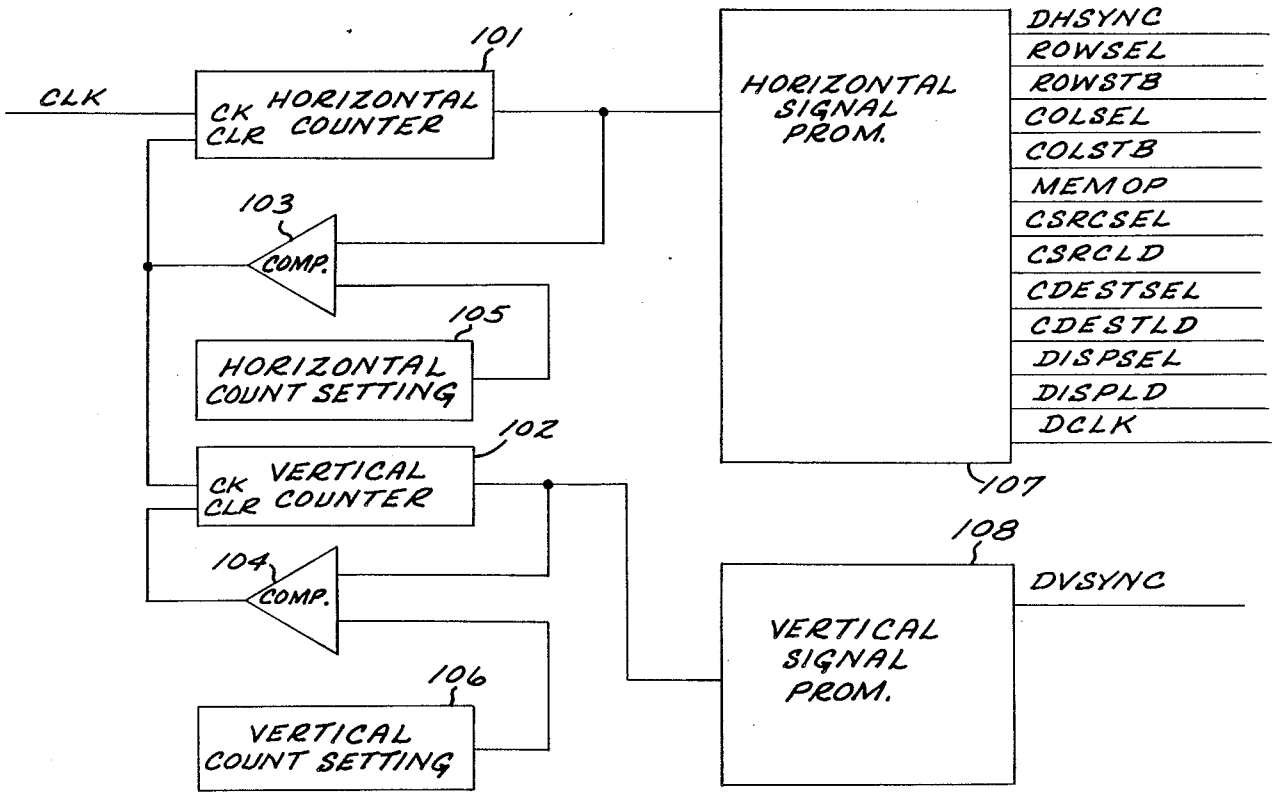
FIG. 8 SYNC/SIGNAL GENERATOR

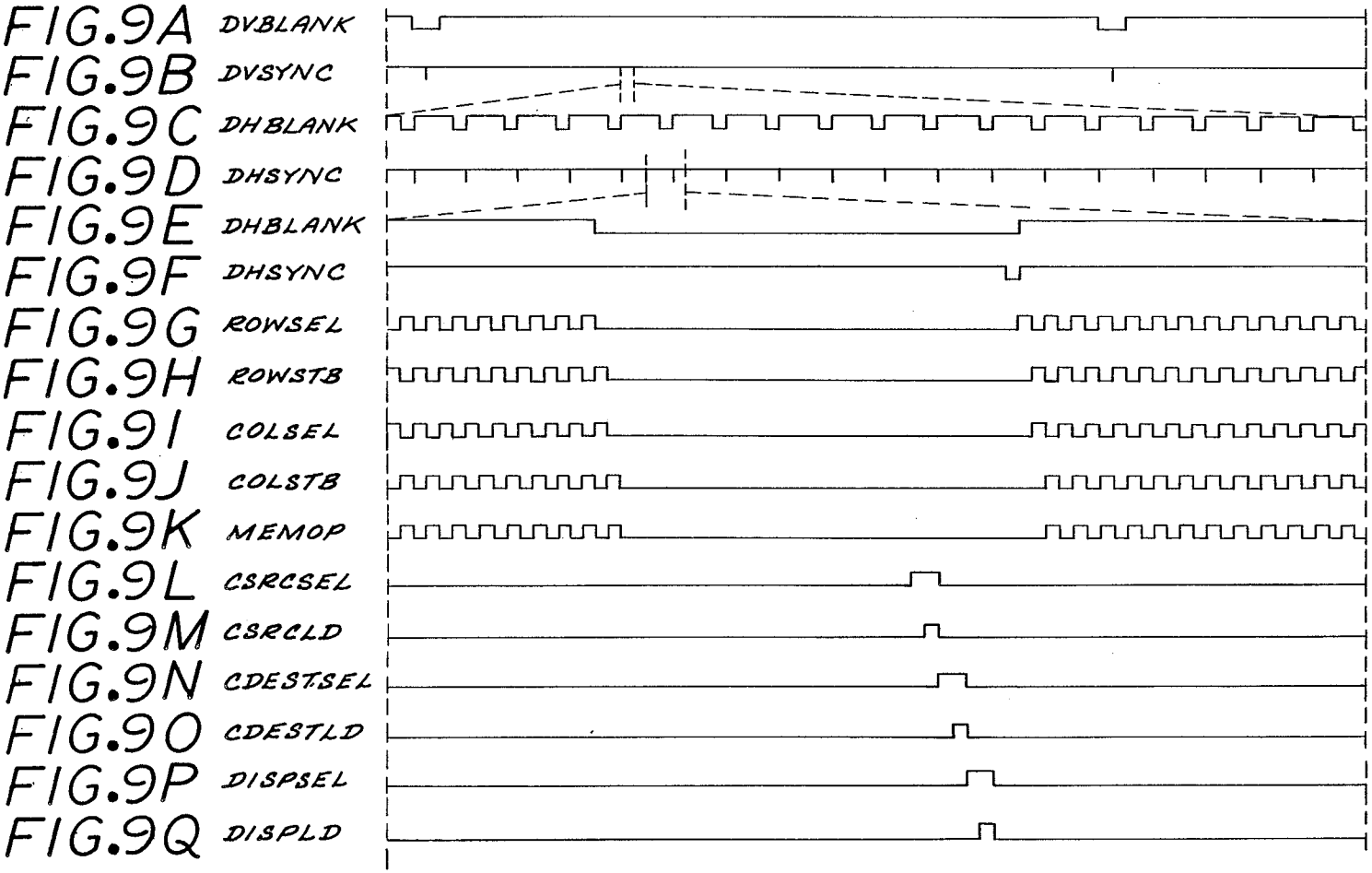
FIG.9A DVBLANK
FIG.9B DVSYNC
FIG.9C DHBLANK
FIG.9D DHSYNC
FIG.9E DHBLANK
FIG.9F DHSYNC
FIG.9G ROWSEL
FIG.9H ROWSTB
FIG.9I COLSEL
FIG.9J COLSTB
FIG.9K MEMOP
FIG.9L CSRCSEL
FIG.9M CSRCLD
FIG.9N CDESTSEL
FIG.9O CDESTLD
FIG.9P DISPSEL
FIG.9Q DISPLD

APPARATUS FOR RECEIPT AND DISPLAY OF RASTER SCAN IMAGERY SIGNALS IN RELOCATABLE WINDOWS ON A VIDEO MONITOR

BACKGROUND OF THE INVENTION

The present invention relates generally to apparatus for presentation of raster format imagery signals in relocatable inset windows on video displays, and more particularly to such apparatus useful in processing of real-time continuously updated imagery signals within a display generation device.

Although apparatus of this general type are available, they are currently limited in their performance. Many methods of providing continuous image updates to inset windows do not permit arbitrary window size, variable input frequency or relocation of the window to any region of the display. By fixing the size, update rate and location of the inset window, as is popular in picture within picture (pix-in-pix) television receivers, most of the complications of synchronization of input and output signals are avoided. Although this method can be used to obtain an artifact free output signal, it is undesirable for applications requiring multiple input signal formats or relocation of the inset window on the display.

Another method of synchronizing the input signal with the display refresh of the frame buffer uses a parallel double buffer architecture. In this scheme, the display is refreshed out of one buffer, while the input image is loaded into the other. At the end of the display refresh following a conclusion of one input frame, the roles of these two buffers alternate. If the end of the display refresh does not occur prior to the start of the next input frame (as is often the case), it is necessary to hold off input for one frame time or provide some other mechanism to ensure the input data does not overlap the display refresh. This method is undesirable due to the need to periodically interrupt the input signal, causing a lack of continuity in the display output. Also, parallel double buffer architectures provide complications when other processes utilizing other windows are involved since it is necessary to accommodate these activities with the two alternating frame buffers.

Accordingly, it is an object of this invention to provide an image data input interface and memory system which can process real time continuous updates of new image frames, placing the data in relocatable windows on a display.

Another object of the invention is to provide a display free of artifacts while maximizing the display update rate.

A further object of the invention is to provide a display system which operates with any raster image data input over a wide range of input frequencies and display dimensions.

SUMMARY OF THE INVENTION

An interface and memory system for a display system is disclosed which receives a digital raster scan image from an external source and displays this image as an inset window on a video monitor display. The input image is asynchronous with respect to the monitor display refresh operation. The inset window is relocatable to any random location within the display.

The window input image is buffered in a pipeline dual memory system in order to synchronize reception of this signal with the monitor display refresh operation. The pipeline dual memory system includes update and display buffers. If the vertical rate of the window input signal is greater than the vertical rate of the monitor display refresh, the update buffer copies its entire contents into the display buffer every time the window input signal completes a frame update. The copy operation is initiated just before the start of the active portion of the input frame at a vertical position equal to the top line of the input window. The copy operation proceeds ahead of the window input signal, copying one line at a time from the update buffer to the display buffer during each monitor display refresh horizontal blanking interval. Since the copy operation proceeds ahead of the window input signal, it is certain that a complete input frame will be copied and since the copy operation is synchronous with the monitor display refresh operation, it is impossible for the copy operation to cross over or otherwise interfere with the monitor display refresh operation. A continuous display is provided since no interaction between input, copy, and display refresh operations is possible.

If the vertical rate of the window input signal is less than the vertical rate of the display refresh operation, the copy operation from the update to the display buffer is initiated just after the start of the active portion of the window input signal. The copy operation proceeds behind the window input signal synchronous with the monitor display refresh operation. If the copy operation has not proceeded past the bottom of the input window before the start of subsequent input frames, these frames are skipped. A continuous display is provided since no interaction between input, copy, and display refresh operations is possible.

A further aspect of the invention relates to a means for generating the plurality of synchronization control signals for operating the pipeline dual memory system. The synchronization signal generator includes a counter for providing a unique output count corresponding to each pixel location in a raster line of the display operation, and a digital memory addressed by the counter output signal. The memory has a corresponding output terminal for each control signal, and is programmed with data defining the desired state of each control signal for each pixel location.

BRIEF DESCRIPTION OF THE DRAWINGS

These and other features and advantages of the present invention will become more apparent from the following detailed description of an exemplary embodiment thereof, as illustrated in the accompanying drawings, in which:

FIGS. 4A–4F are waveforms showing the real time data input timing of the input, display and copy operations illustrated in FIGS. 3A–B.

FIG. 6 is a block diagram of the apparatus for receipt and display of raster scan images in relocatable windows on a video monitor comprising the system of FIG. 5.

FIG. 8 is a block diagram of the synchronization signal generator of the apparatus of FIG. 6.

FIG. 9 is a timing diagram of the signals produced by the synchronization signal generator of FIG. 8.

DETAILED DESCRIPTION OF THE PREFERRED EMBODIMENTS

Figure 1:
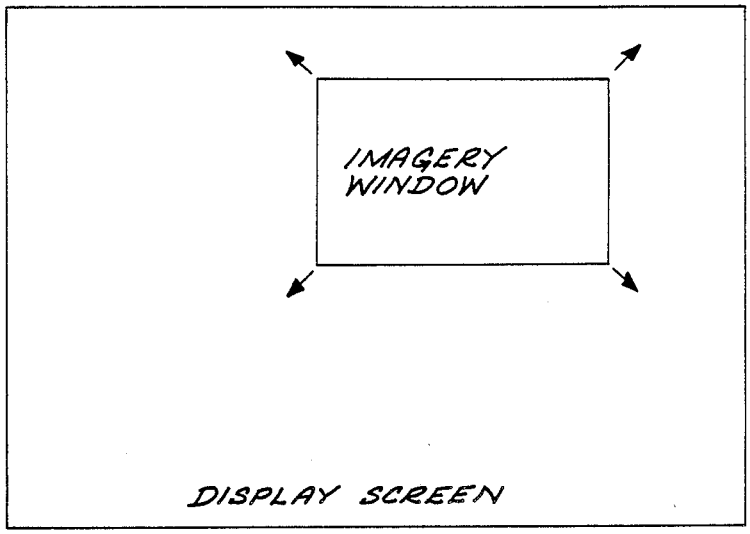
FIG. 1 is a pictorial representation of the type of image presentation that would be produced on a monitor display system employing the present invention.

The present invention provides a relocatable window within a larger display screen into which real-time, continuously updated raster format imagery data can be placed, as shown in FIG. 1. The input window is of arbitrary size relative to the display and can be located anywhere within the display field of view.

Overview of the Invention

Figure 2:
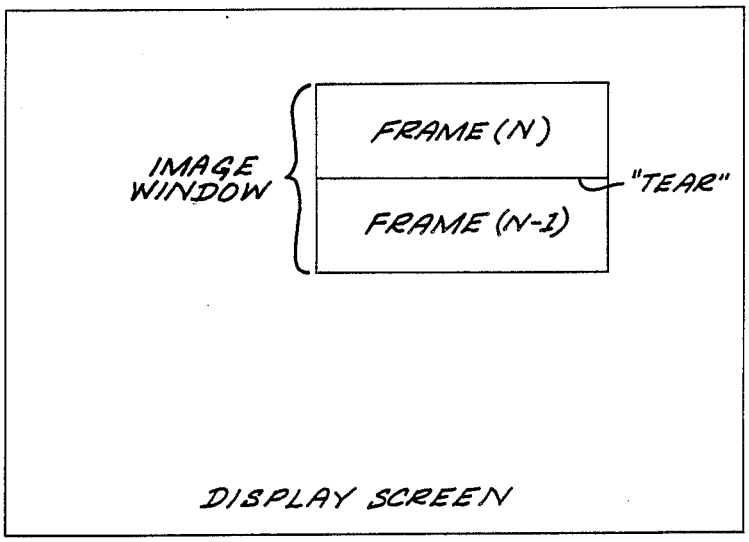
FIG. 2 is a pictorial representation of the type of image presentation difficulty that is avoided through the use of the present invention.

The primary objective of this invention is to accomplish the above function without introduction of discernible anomalies or artifacts into either the input window or background display. The principle difficulty in accomplishing this goal is to compensate for the phase relationship between the window input signal and the monitor display refresh operation. Since the window input image is continuously updated, it is necessary to guarantee that an entire frame of the window input image is displayed during a single monitor display refresh operation. If, as is shown in FIG. 2, a portion of one input frame is displayed in conjunction with a portion of a subsequent input frame, a noticeable "tearing" of the window input image will be observed. In dynamic operation, since there is no fixed relationship window between the input signal and the monitor display refresh and therefore the position of this tearing, the anomaly will flutter along the screen in an objectionable manner. This invention compensates for this effect through the use of a properly controlled pipelined dual-memory architecture.

Figure 3A:
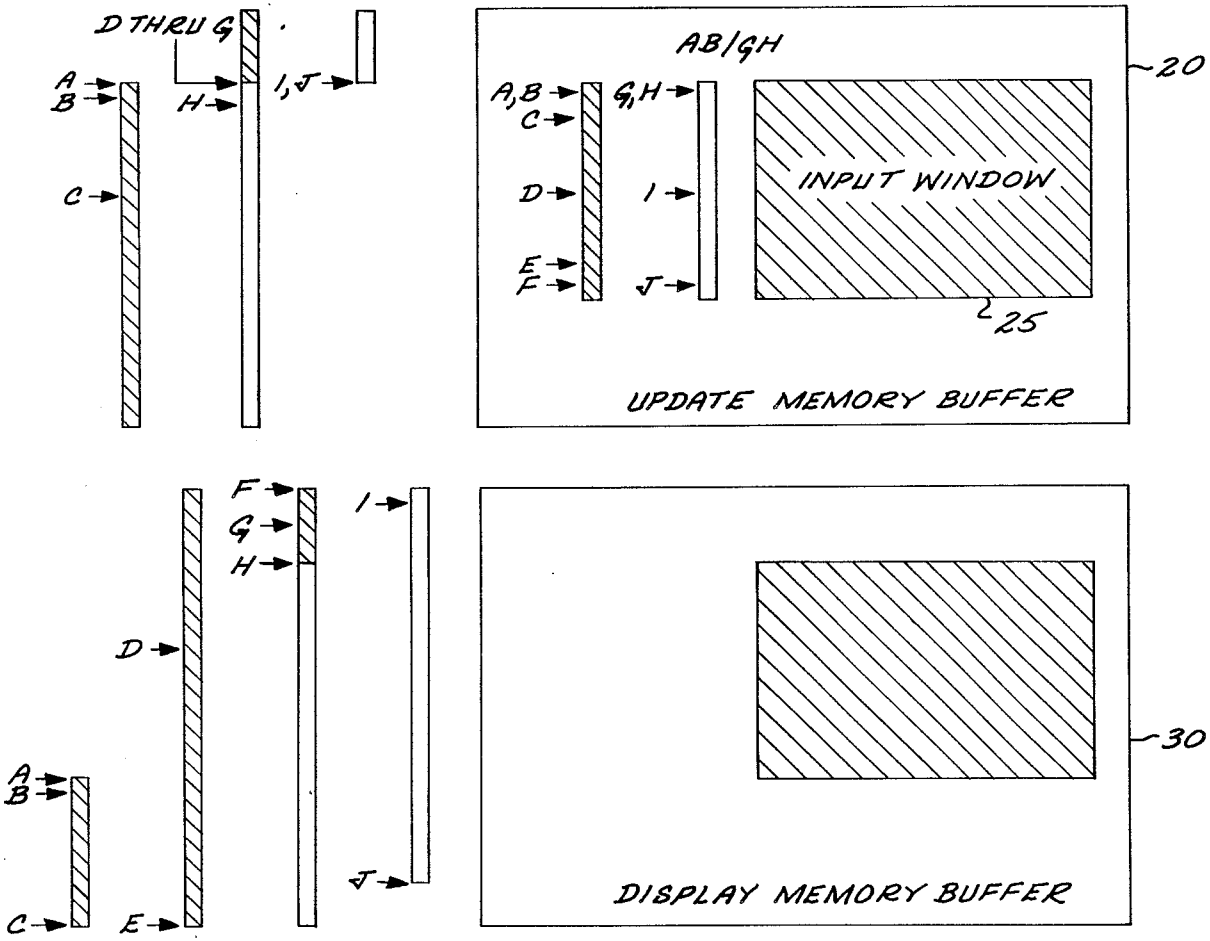
FIGS. 3A–B are diagrams of the relative positions of the input, copy and display functions during dynamic operation of the present invention for two input data rate conditions.

A graphical representation of the frame buffer structure and timing process of an embodiment of the invention is shown in FIGS. 3A–B and 4A–F, respectively. Referring to FIG. 3A, the apparatus utilizes both "update" and "display" memory buffers 20 and 30, and is capable of transferring or copying data rapidly, at a rate synchronous with the memory display refresh, from the update memory 20 to the display memory 30. For the sake of generality, the update memory 20 is shown as equal in size to the display memory 30. If more is known about the parameters of the window input image size, the update memory 20 need only be scaled to this size. In any case, the implementation need only ensure that a synchronous relationship exist between the transfer operation and the monitor display refresh, particularly with respect to the vertical rate, as will be seen in the follow description of the process.

The input process is shown graphically in FIG. 3A, which illustrates the case where the input window data vertical rate is less than the display refresh vertical rate. As used herein, the input window data vertical rate is the rate at which successive lines of input window data are written to the update buffer. The display refresh vertical rate is the rate at which successive lines of data are read to drive the raster scan. In each case, it is the rate at which the respective operation proceeds vertically through the respective data set. The vertical bars adjacent to the input window 25, the update memory 20 and the display memory 30 indicate the relative position of the periodic operations at various points during a representative time interval. The shading of these bars shows the relationship of the operations to two successive window input frames, with the black-shaded bars representing the first frame and the non-shaded bars representing the second frame. The corresponding waveforms of the periodic signals or operations "INPUT," "COPY" and "DISPLAY" are illustrated in FIGS. 4A–4C, with a "high" level reflecting an active phase of operation and a "low" signal reflecting an inactive phase. Points A–J indicate particular times during the two successive frames. For example, the COPY position A at the shaded bar in FIG. 3A corresponds to the time A of FIGS. 4A–4D.

At time A, the window input signal is almost at the end of the inactive portion of its cycle, reflecting a position close to the end of the input vertical interval. Note that the position of the display refresh operation ("DISPLAY") at this time A is arbitrarily set in the middle of the active phase. This relationship is not fixed and the display refresh operation can be at any point in its cycle at the end of the window input vertical interval. However, depending on the actual implementation of the invention, certain minor constraints which must be compensated may exist with regard to convergence of refresh and copy operation vertical positions at this point in time. One such case will be described below in further detail.

At time A, the copy operation is initiated and data in the update memory 20 starts transferring to the display memory 30 at a vertical location in the memory 30 equal to the top of the input window, as shown in the update memory timing bars. The optimal case for this embodiment is the case wherein one line of window update data is copied from the update memory 20 to the display memory 30 for every line of the display refresh operation during the horizontal interval of the monitor display operation. If this is the case, the start of the data operation from the update memory 20 to the display memory 30 is completely independent of the display refresh position. Due to certain device constraints, as mentioned above, this copy operation may have to be performed once every several horizontal lines, instead of one line copied for each line displayed. If the display refresh happens to be within this group of lines of the top of the input window at this time, the copy operation must simply be held off for an adequate period of time to ensure no convergence of the copy and display refresh operations.

At time B, several lines from the update memory 20 have been copied to the display memory 30 as is shown by the timing bars adjacent to the update memory 20. The display refresh operation has moved an identical number of lines down the vertical extent of the display memory 30. Note that throughout the rest of the active portion of the copy cycle, the timing relationship of the copy operation to the display refresh operation is constant. At point B, the new frame of window input data starts arriving and is loaded into the appropriate location within the update memory 20. Since the vertical rate of the input signal is less than that of the copy and refresh operations, at point C it can be seen that the input operation has not proceeded as far as either of the transfer and refresh operations, as indicated by the vertical tuning bars shown adjacent the input window and within the update memory buffer. At point C the display refresh goes into the inactive, vertical blanking interval, this having no effect on the input or copy operations. Note that throughout the just concluded display refresh active phase, only input window data from the previous frame has been displayed.

The input, copy and display refresh operations continue, with the copy and display refresh operations proceeding ahead and moving faster vertically than the input operation. When the copy operation reaches the bottom extent of the update memory 20, it wraps around to the top extent of the memory 20 and continues until time D, when it returns to the top of the input window. This concludes the copy operation. As can be seen from the COPY waveform (FIG. 4B), the copy operation at time D now becomes inactive. The input and display refresh operations continue, however, and at time E the display refresh completes an active trace period and enters another vertical blanking interval. At time F the input operation completes an active trace period and enters vertical blanking. When the input operation is almost through with the blanking period, the copy operation is initiated at time G and the cycle starts over again.

Active input operation begins a new frame at time H and continues through point J. Note that the corresponding vertical positions of the display refresh at time H shown on the timing bars adjacent to the display memory is much different in this cycle than at time A in the previous cycle. But since the relative position of the copy operation and display refresh is constant once the transfer has started, there is no possibility of displaying data from two different frames in the same display refresh period.

Figure 3B:
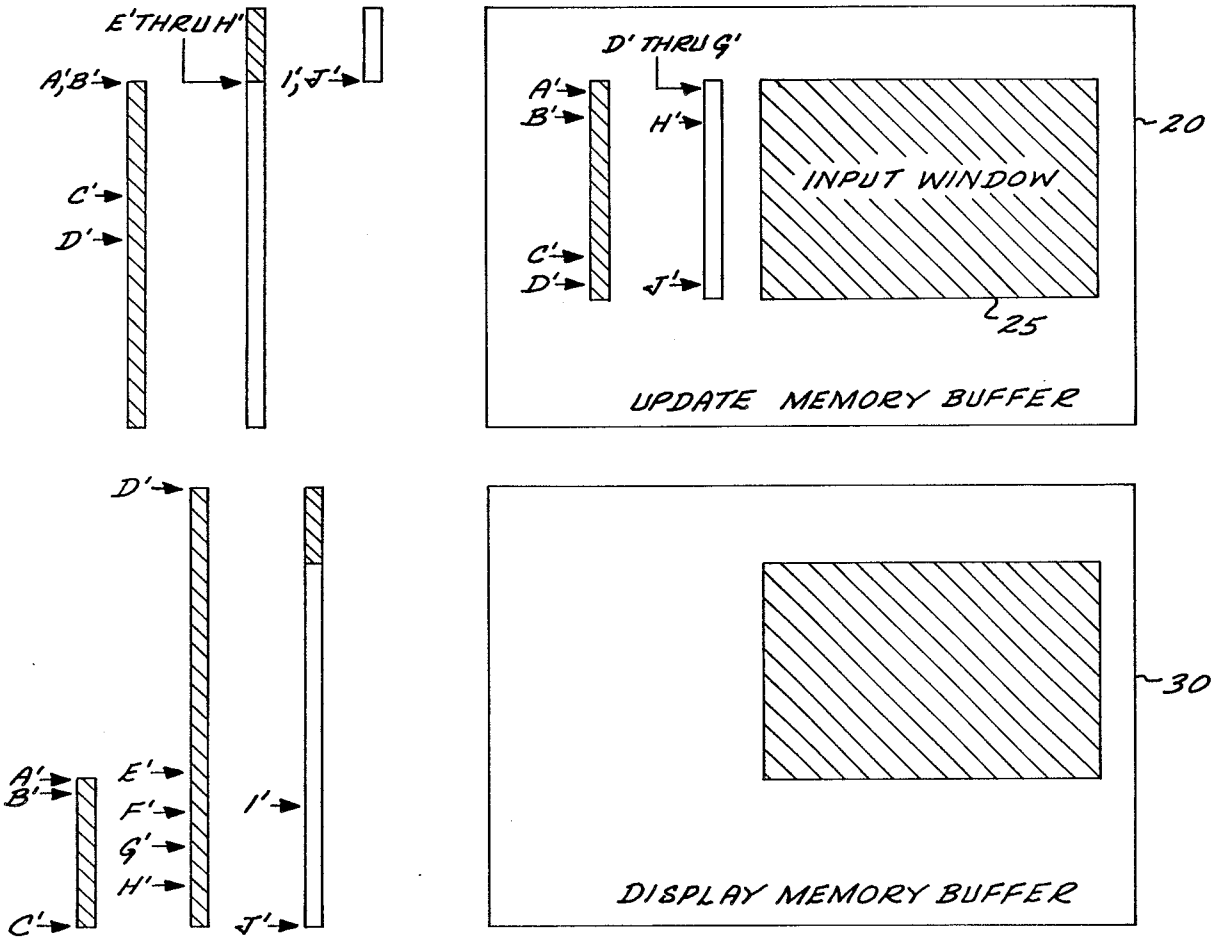

The input process for the case where the input window data vertical rate is faster than the display refresh rate is shown graphically in FIG. 3B. The shaded vertical bars adjacent to the input window 25, the update memory 20 and the display memory 30 indicate the relative position of the periodic operations at various points during a representative time interval. The corresponding waveforms of the periodic signals or operations "INPUT," "COPY" and "DISPLAY" are illustrated in FIGS. 4D–4F.

At time A', the window input signal is at the end of the inactive portion of its cycle, reflecting a position at the end of the input interval when the input of data to the input window starts. At time B', the copy operation is initiated and data in the update memory 20 starts transferring to the display memory 30 at a vertical location in the memory 30 equal to the top of the input window, as shown in the update memory timing bars. At time B', several lines from the window input source have been loaded into the update memory 20 as is shown by the timing bars adjacent to the update memory 20.

At time C' several lines have been copied for the update memory 20 to the display memory 30. The display refresh operation has moved an identical number of lines down the vertical extent of the display memory 30. Note that throughout the rest of the active portion of the copy cycle, the timing relationship of the copy operation to the display refresh operation is constant. Since the vertical rate of the input signal is greater than that of the copy and refresh operations, at point C' it can be seen that the input operation has proceeded further than either of the transfer and refresh operations, as indicated by the vertical timing bars shown adjacent the input window and within the update memory buffer. At point C' the display refresh goes into the inactive vertical blanking interval, this having no effect on the input or copy operations. Note that throughout the just concluded display refresh active phase, only input window data from the current frame has been displayed.

The input, copy and display refresh operations continue, with the copy and display refresh operations proceeding behind and moving slower vertically than the input operation. At time D' the input frame completes and goes into the inactive blanking interval. At this point further receipt of new data is halted until the copy operation completes. The copy operation continues and when it reaches the bottom extent of the update memory 20, it wraps around to the top extent of the memory 20 and continues until time E', when it returns to the top of the input window. This concludes the copy operations. As can be seen from the COPY waveform (FIG. 4E), the copy operation at time E' now becomes inactive. The input operation is now reactivated for the next whole frame. The display refresh operation continues.

At time F' the input operation completes the active trace period which has been skipped and enters vertical blanking. When the input operation is through with the blanking period, the input operation is initiated at time G' and the cycle starts over again.

The next copy operation begins a new frame at time H' and continues through point J'. Note that the corresponding vertical positions of the display refresh at time H' shown on the timing bars adjacent to the display memory is much different in this cycle than at time A' in the previous cycle. But since the relative position of the copy operation and display refresh is constant once the transfer has started, there is no possibility of displaying data from two different frames in the same display refresh period.

The Preferred Embodiment

Figure 5:
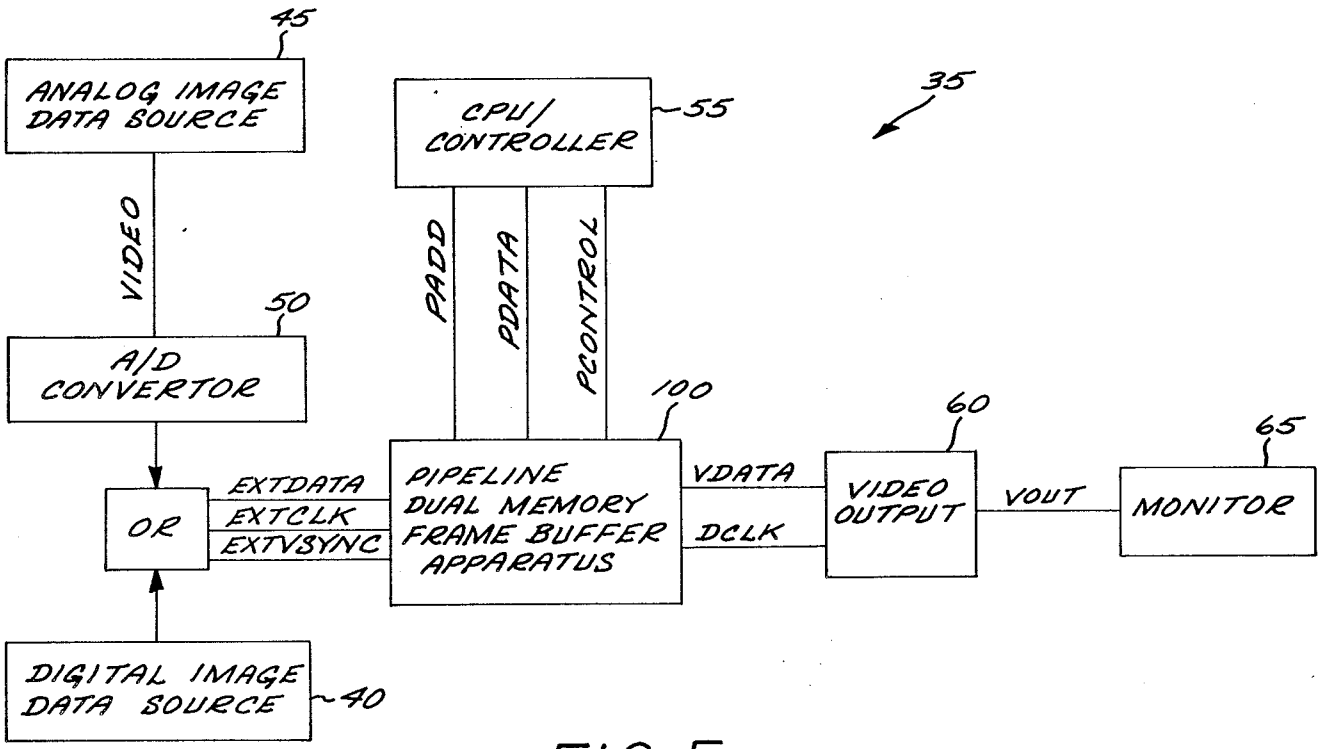
FIG. 5 is a general block diagram of a display system embodying the present invention.

FIG. 5 shows a generalized block diagram of a display system 35 embodying the invention. The window input data source may comprise a digital image data source 40 such as a digital processor, or an opto-electronic image scanner. Alternatively, the window input data source may comprise an analog image data source 45, such as a camera or receiver, providing analog image data which is converted into digital image data by analog-to-digital converter 50. The function of the window input data source is to provide digital raster image data which is to be displayed on a window on the display monitor. In the disclosed embodiment, the window input data source provides the data in the form of serial digital data bits or bytes which define the status of the display pixel elements comprising the window.

The window image source provides its data to the pipelined dual memory frame buffer apparatus 100, which is described more fully with respect to FIG. 6. A central processing unit (CPU) controller interfaces with the apparatus 100 and comprises means for providing window definition signals which define the size and location of the window on the monitor display 65.

The apparatus 100 provides digital output signals defining the status of each pixel element on the display monitor 65. These digital output signals drive the video output interface circuitry 60, which converts the digital output signals into raster-scanned signals for controlling the display monitor 65. The display monitor 65 comprises a raster-scanned cathode ray tube (CRT) device. In a typical application for which the invention is particularly well suited, the system 35 will comprise a computer work station with a high resolution monitor for displaying text and/or graphics.

FIG. 6 illustrates a schematic block diagram illustrative of the pipelined dual memory frame buffer apparatus 100. In this embodiment of the apparatus 100, the only externally generated signals are those emanating from the window input data source and from the CPU controller 55. External input signals all have the prefix "EXT," whereas processor-generated signals have the prefix "P." The processor-generated signals serve to load the control registers 111, 112, 125, 126, 129 and 160 comprising the apparatus 100, and comprise the PADD bus, PF/S signal, the PDATA bus and the PLDxxx signals. These control registers define the initial parameters of the system. The Input Start X Register 111 is loaded with the column address of the desired left border of the input window. The Input End X Register 112 is loaded with the column address of the right border of the input window. The Update Base Y Register 125 is loaded with the base row address in memory of the update frame buffer 20. The Input Start Y Register 126 is loaded with the row address of the desired top border of the input window. The Display Base Y Register 129 is loaded with the base row address of the display frame buffer. The Copy Length Register 160 is loaded with the number of rows in the update frame memory buffer 20.

Figures 7A, 7B, 7C, 7D, 7E, 7F:
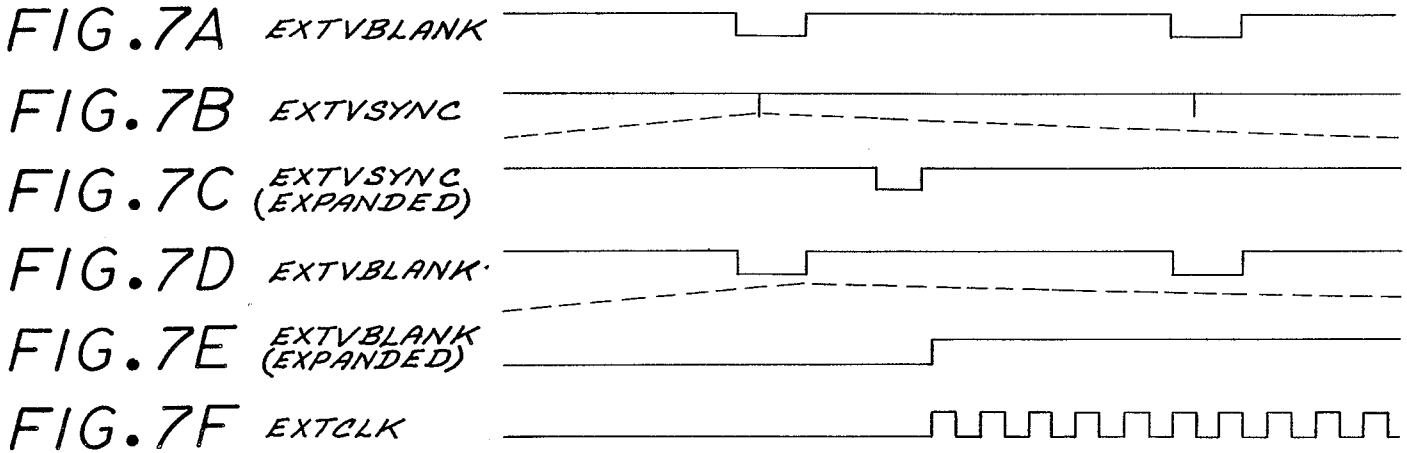
FIG. 7 is a timing diagram of the signals produced by the external interface employed with the apparatus of FIG. 6.

FIG. 7 illustrates the external input signals that are used to transmit and control the reception of external window input data. The EXTDATA bus conveys input window data from the input source to the Input Data first-in first-out buffer ("FIFO") 110. The window input data is sequentially clocked into the FIFO 110 by the EXTCLK signal gated with the signal EXTACTIVE signifying an active input frame. Additionally the EXTVBLANK signal is used to clock the condition of the COPYACTIVE signal into latch 161. The FIFO 110 and the control registers are used to support continuous input to the apparatus 100 during memory transfer operations, and to align the input control pulses with the rate buffered data, as will be further described below.

Input image data to be stored in the video memory 150, which comprises the update memory buffer 20 and the display memory buffer 30, is input from the external window image source and from the controller 55. The window data is provided on the EXTDATA bus. The controller 55 provides the background display data, i.e., the image data defining the display outside the borders of the window, via the data bus PADD. A data multiplexer 144 selects either the serial window data output from the FIFO 110 or the background display data, under control of the controller-generated signal PSEL, and provides the selected data (MEMDATA) to the data input port of the video memory 150.

The apparatus 100 of FIG. 6 further comprises the Input X Counter 121, whose function is to maintain the X (or column) memory address of the window data provided by the external image source which is being loaded into the video memory 150. The counter 121 is loaded with a start address comprising the sum (operation 130) of the states of the registers 125 and 126.

The Copy Source Y Counter 133 maintains the Y or row memory address of the update memory location being copied to the memory buffer during the copy operation. The counter 133 is loaded with the same start address as is provided to counter 132.

The Copy Destination Y Counter 134 maintains the Y or row address of the memory buffer location to which window data is being copied during the copy operation. It is loaded with a start address which is the sum (operation 136) of the state of the Input Start Y Register 126 and the Display Base Y Register 129.

The Display Y Counter 135 maintains the current row address of the display refresh operation. The Counter 135 is loaded with a start address from the Display Base Y Register 129.

The Copy Counter 165 is loaded with the number of rows of data to be copied from the update to the display memory, and is decremented to zero by the signal DHSYNC signal. The controller 55 provides the data defining the number of rows to the Copy Length Register 160 via the PDATA bus.

The states of each of the counters 121, 132, 133, 134 and 135, together with the PADD bus are connected to corresponding inputs A–G of the address multiplexer 138. The address data on the PADD bus determines the memory locations of the background data being loaded into the video memory 150. The multiplexer 138 selects one of these input address sources and provides the selected address data as the MEMADD signals provided to the address port of the video memory 150. The multiplexer 138 is controlled by the signals ROWSEL, COLSEL, SCRCSEL, CDESTSEL and DISPSEL, all provided by the synchronization signal generator 172, and PSEL provided by the CPU controller 55.

Various internal control signals for controlling the operation of apparatus 100 are generated by a synchronization signal generator 172, shown in further detail in FIG. 8. In accordance with one aspect of the invention, the generator 172 employs a counter modulo equal to the vertical display interval times the clock rate, the counter state serving to address look-up tables stored in the Horizontal Signal PROM 107 and the Vertical Signal PROM 108. A Horizontal Counter 101 is clocked by the CLK signal generated by the oscillator 170. The Horizontal Counter Setting 105 retains a digital value equal to the number of digital data bits defining a horizontal (raster) line. For example, a high resolution monitor may employ 1000 pixels per line. The counter 101 state is compared by comparator 103 with the predetermined horizontal counter setting 105, and the counter 101 is reset by the comparator 103 output when the count state reaches the setting 105 value. The comparator 103 output is thus reset at the end of every horizontal line, and this signal also serves to clock the Vertical Count 102. The modulo of the counter 102 is determined by the Vertical Count Setting 106 and the comparator 104 in a similar manner to that of the Horizontal Counter 101.

The count state of the Horizontal Counter 101 is employed to address the Horizontal Signal PROM (programmable-read-only-memory) 107. The count state of the Vertical Counter 102 addresses the Vertical Signal PROM 108. Each count of the Horizontal Counter 101 corresponds to a particular digital value comprising a particular raster line comprising a display frame. The PROM 107 outputs comprise respectively the signals DHSYNC, ROWSEL, ROWSTB, COLSEL, MEMOP, CSRCSEL, CSRCLD, CDESTSEL, CDESTLD, DISPSEL, DISPLD and DCLK. For each particular counter state, the outputs of the PROM 107 establish the active/non-active state of each of these signals. The PROM 107 may comprise, for the case of a Horizontal Count Setting 105 value of 1000, e.g., two 1K by 8 bit PROM devices, wherein selected ones of the output terminals correspond to one of the thirteen control signals identified above. For a given count of the Counter 101, the PROM 107 is programmed with appropriate data defining the active/non-active status of each signal at that particular count location in the horizontal line. The Vertical Signal PROM 108 is addressed in a similar fashion by the count state of the Vertical Counter 102. The single output of the PROM 108 provides the DVSYNC signal. The minimum size of the PROM 108 is equal to the number of lines in a given frame on a high resolution monitor may comprise, e.g., 1024 lines, and the PROM 108 for such an example has a required minimum size of 1024 bit storage locations.

FIGS. 9A–9Q illustrates the timing signals generated by the Synchronization Signal Generator 172. All these signals are periodic with a maximum period of one display refresh cycle.

FIG. 9A shows the signal DVBLANK, the monitor display refresh vertical blanking signal. This signal is high during the active portion of the display refresh cycle and low during the vertical blanking interval.

DVSYNC (FIG. 9B) is a pulse signal during the display blanking interval.

DHBLANK (FIG. 9C) is expanded relative to the above vertical interval signals. DHBLANK is high during the active portions of the horizontal trace and low during horizontal retrace. DHSYNC (FIG. 9D) is a pulse during horizontal retrace.

The relationship of the DHBLANK and DHSYNC signals in expanded form is illustrated in FIGS. 9E and 9F. The remaining signals ROWSEL (FIG. 9G), ROWSTB (FIG. 9H), COLSEL (FIG. 9I), COLSTB (FIG. 9J), MEMOP (FIG. 9K), CSRSCEL (FIG. 9L), CSRLD (FIG. 9M), CDESTSEL (FIG. 9N), CDESLLD (FIG. 90), DISPSEL (FIG. 9P), and IDSPLO (FIG. 9Q) are shown relative to this degree of expansion. These signals are periodic with respect to the horizontal interval and control access to the video memory 50 for the various transfer operations performed by this embodiment of the invention.

The Input Operation

The input process performed by the system 35 starts when an EXTVSYNC pulse is received. If the copy operation is not active, latch 161 clocks in a high level which makes the EXTACTIVE signal go high. Delay block 183 has two modes of operation controlled by the PF/S signal from the processor interface. In the case where the input signal vertical rate is slower than the display refresh operation, a short delay is imposed by this block 183 on the EXTACTIVE signal to generate a high level on COPYST and set latch 163, making the COPYON signal go high just prior to the start of the input active phase. This allows the copy operation to proceed ahead of the input as required for this case. If the vertical rate of the input data is greater than the vertical rate of the display refresh, the delay block 183 delays COPYST significantly longer than the input blanking period to allow the receipt of several lines of data prior to starting the copy operation. This assures the copy will proceed behind the input operation. Note that if the copy operation is not completed prior to the start of another input frame, latch 161 will clock in a low level the EXTACTIVE signal will remain low for the entire input frame and no data will be loaded into the FIFO 110.

At the start of the active input frame, the signal IRDY on the Input Data FIFO 110 goes high, signifying reception of a data element by the FIFO. The signal, IRDY corresponds to the INPUT signal of FIG. 4A. IRDY is gated with the MEMOP signal (generated by the Synchronization Signal Generator 172) by an AND gate 141 to generate the signal ICLK. As illustrated in FIG. 9K, MEMOP is a clock signal generated during the active phase of the display horizontal interval. During the clocking portion of MEMOP, no memory transfer operations are performed, i.e., no loading or reading of the Shift Register 151 is performed, and it is possible to load input data into the Video Memory 150. Addressing of the memory write cycle is controlled by the free running timing signals ROWSEL, ROWSTB, COLSEL and COLSTB. The ROWSEL and COLSEL signals are used to select row and column addressing by the Address Multiplexer 138 for the MEMADD bus. The ROWSTB and COLSTB signals latch the selected address into the Video Memory 150. These signals do not cause a write operation to memory to occur as this is gated by the occurrence of ICLK. So if IRDY is set, the Input Data FIFO 100 will shift out, a write to the Video Memory 150 will occur and the Input X Counter 121 will increment.

The input operation will continue writing to the Video Memory 150 as long as the signal IRDY is active high. The Video Memory 150 input bandwidth is greater than the window data input rate, i.e., the maximum rate at which the data can be clocked into the Video Memory 150 is much greater than the rate at which the window input data is loaded into the FIFO 110. As a result, IRDY will frequently go low for one cycle. When this happens ICLK will not occur and the memory write cycle will be skipped. In this case the Input Y Counter 132 is not incremented. Also during the course of the input process, it is necessary to suspend memory write cycles during at least a portion of the display refresh horizontal blanking interval. As discussed above, the MEMOP signal does not clock during this interval and data that is received is buffered up in the Input Data FIFO 110.

Addressing of the input data is provided by the Input X Counter 121 and the Input Y Counter 132. These counters are loaded by the CPU controller 55 prior to the start of the active portion of the input operation with the top left address of the input window. This process is further described below in conjunction with the discussion of the start of the transfer process. The counters 121 and 132 are incremented by ICLK as the memory write cycles are performed. When the X address is equal to the address of the right border of the input window residing in the Input End X Register 112, comparator 116 generates XDONE which reloads the Input X Counter 121 and increments the Input Y Counter 132. The input process proceeds until the next input vertical blanking interval when EXTCLK ceases to clock and IRDY ceases to go high.

The Copy Operation

The copy process for this embodiment of the invention begins with the reception of the signal EXTVSYNC by the latch 161. This occurs in the blanking period long enough after reception of the last data item from the previous input frame to insure that all data from the previous frame has been stored in the video memory 150. During time EXTCLK is inactive and no additional window input data is loaded into the Input Data FIFO 110. If the copy operation from the previous cycle is completed, latch 116 is set, creating an active high level output on signal EXTACTIVE. After the appropriate delay to handle the two cases as described above, the signal COPYST (copy start) goes active high.

The signal COPYST does several things. The Input X Counter 121 is loaded with the content of the Input Start X Register 111, the address of the left border of the input window. The Input Y Counter 132 and Copy Source Y Counter 133 are loaded with the sum of the Update Base Y Register 125 and the Input Start Y Register 126 so that they contain the update memory row address at which is stored the top of the input window. The Copy Destination Y Counter 134 is loaded with the sum of the Input Start Y Register 126 and the Display Base Y Register 129 so that it contains the display memory row address display memory of the top of the input window. Latch 163 is set, making COPYON high, which enables the Copy Counter 165 to begin counting down. (The COPYON signal corresponds to the COPY signal of FIG. 4B.) COPYON also enables "AND" gate 166 to generate the RDSR (read shift register) signal which causes the copy operation to occur.

The copy process comprises loading of the Shift Register 151 with an entire horizontal line from the Video Memory 150 and reading it back to another row location within the memory 150. The transfer operation is performed every horizontal blanking period (of the monitor display operation) that the signal COPYON is set. As a result, the relative position of the display refresh operation and the current transfer row position is constant throughout the copy operation.

The operation is controlled by the free-running signals generated by the Synchronization Signal Generator 172 and the gating COPYON signal described above. The CSRCSEL signal selects the address in the Copy Source Y Counter 133 to be placed by the Address Multiplexer 138 on the MEMADD bus and SCSRCLD causes the transfer to the Shift Register 151 of the selected row of Video Memory 150 pixel data. The CDESTSEL signal selects the address in the Copy Destination Y Counter 134 to be placed by the Address Multiplexer 138 on the MEMADD bus, CDESTLD generates RDSR if COPYON is high and causes the transfer from the Shift Register 151 to the selected row of video memory 150. As a result of these steps, the row of window input data is copied from the update buffer 25 to the display buffer 30 comprising the Video Memory 150.

Every horizontal blanking interval (of the display operation, the Copy Source Y Counter 133 and the Copy Destination Y Counter 134 are incremented, and the Copy Counter 165 is decremented. The transfer operation proceeds until the copy counter reaches zero and a terminal count COPYDONE signal resets latch 163. When COPYON goes low, RDSR is held off, and the transfer of data from the shift register 151 to the display portion of video memory 150 does not occur.

The Display Refresh Operation

The set-up of the display refresh operation is also performed during the horizontal blanking interval. After the transfer operation from the update to the display buffer is concluded, the DISPSEL signal selects the address in the Display Y Counter 135 to be placed by the Address Multiplexer 138 on the MEMADD bus, and DISPLD causes the transfer to the Shift Register 151 of the selected row of video memory 150 pixel data. At the start of the active phase of the display refresh the DCLK signal (display clock) starts shifting video pixel data VDATA out of Shift Register 151 to refresh the display. VDATA is received by the video output circuit 60 and is converted into an analog signal VOUT which is used to drive the CRT monitor 65. In the case of a monochrome system, VDATA would comprise one channel of pixel data, and can be implemented with a single digital-to-analog converter circuit. In the case of color operation, VDATA will comprise three channels, red, green and blue. This embodiment can be implemented by associating each channel of the VDATA bus respectively with red, green and blue digital-to-analog converters.

An apparatus for the display of real-time raster scan imagery signals in relocatable windows on a raster scan video monitor has been described. It is understood that the above-described embodiment is merely illustrative of the possible specific embodiments which may represent principles of the present invention. For example, in the course of the active display refresh operation, the shift register can be reloaded with pixel data from other portions of the display memory buffer, and the output process can continue without interruption. In such an embodiment, the output display is actually assembled from several non-contiguous portions of memory. Write operations to memory during the input operation for the setup of this reload operation can simply be suspended. Also, a plurality of such apparatus incorporating the basic principles of the present invention may be used to coordinate the display of a plurality of dynamic windows on the display. Other arrangements may readily be devised in accordance with these principles by those skilled in the art without departing from the scope of the invention.

What is claimed is:

1. Apparatus for display of raster scan imagery signals in relocatable windows on a raster scan video display monitor on which the displayed imagery is periodically refreshed at the display refresh rate, said apparatus comprising:

means for providing digital raster scan imagery window input data defining sequential frames of images to be displayed in said window on said monitor, the window input data frame rate being asynchronous with respect to the monitor display refresh rate;

a processor comprising means for providing window definition signals determining the size and location of said window in relation to a monitor display frame;

apparatus responsive to said window definition signals for buffering the input window data to synchronize said data with the display refresh rate and thereby avoid discernible display anomalies, comprising:

a display memory buffer comprising means for storing image frame data representing the raster imagery data defining a complete image frame on said display monitor;

means for reading said image frame data in said display memory buffer to control said display raster, said reading operation occurring at the vertical rate establishing a "display active" time interval of said monitor and being repeated at the display refresh rate;

a window update buffer memory comprising means for storing a frame of the window input digital data;

means for loading said window input data comprising a frame of said window data into said update buffer memory; and means for copying the contents of the update buffer memory into said display buffer at locations corresponding to the window location determined by said window definition signals, said copying operation of one frame being completed within a "copy active" time interval which is no longer than the "display active" time interval of said display monitor.

2. The apparatus of claim 1 further comprising video output circuitry responsive to said means for reading said digital image frame data for providing raster scan image signals compatible with the raster scan operating circuitry of said display monitor.

3. The apparatus of claim 1 wherein said copying means comprises means for transferring data from the update buffer to the display buffer at a vertical rate synchronous with the display refresh rate.

4. The apparatus of claim 1 wherein the input vertical rate of said input window data is slower than said display refresh vertical rate, and wherein said copying means is adapted to commence said copying operation prior to commencement of loading a new frame of window data into said window update buffer memory, whereby the frame of window input data currently stored in said window update buffer memory is copied into said display refresh memory without interference with the new frame of window input data being loaded into said window update buffer memory.

5. The apparatus of claim 1 wherein the input vertical rate of said input window data is faster than said display refresh rate, and wherein said copying means is adapted to commence said copying operation after commencement of loading a new frame of window data into said window update buffer memory, whereby the loading of a complete new frame of window input is performed without interference with said copying operation.

6. The apparatus of claim 1 wherein said processor further comprises means for generating a first signal indicating that the input window vertical rate is slower than the display refresh vertical rate and means for generating a second signal indicating that the input window vertical rate is faster than the display refresh rate, and wherein said buffering means further comprises means responsive to said first signal for commencing said copying operation prior to commencement of loading a new frame of window data into said window update memory, and means responsive to said second signal for delaying commencement of said copying operation until after commencement of loading a new frame window data into said window update memory.

7. The apparatus of claim 1 wherein said processor further comprises means for providing digital raster scan display imagery data, and wherein said buffering apparatus further comprises multiplexing means for loading said processor imagery data into said display memory in multiplex with said copying operation.

8. The apparatus of claim 7 wherein said buffering apparatus further comprises:

a randomly accessible video memory;

said window update memory comprising a first set of locations of said video memory and said display refresh memory comprising a second set of locations of said video memory; and an address multiplexer for providing appropriate write addresses to said video memory to load said input window data into said first set of video memory locations, or to load said processor image data into said second set of video memory data.

9. The apparatus of claim 8 wherein said buffering apparatus further comprises a serial shift register coupled to said video memory, said shift register comprising said copying means and operable to sequentially receive a line of video data from said first set of memory locations and to load said line back into said second set of location in said video memory to copy window input frame data from said input window buffer into said display refresh memory.

10. The apparatus of claim 1 wherein said buffering apparatus comprises a serial first-in-first-out data buffer for receiving said window input data from said window input data means and thereafter transferring said data to said window update buffer memory.

11. The apparatus of claim 1 wherein said copying means comprises means for transferring successive lines of said window input data frame from said update memory buffer at substantially the rate at which successive lines comprising a displayed frame are scanned by said display monitor.

12. The apparatus of claim 1 wherein said means for providing window input data comprises an analog image data source for providing analog image data and a means for converting said analog image data into corresponding digital image data.

13. The apparatus of claim 1 wherein said means for providing window input data comprises a digital processor.

14. The apparatus of claim 1 wherein said buffering apparatus further comprises a synchronization signal generator for generating a plurality of digital control signals controlling the operation of the elements of said buffering apparatus, said generator comprising a counter for providing a unique output count signal corresponding to each pixel location in a raster line of said display operation, and a digital memory addressed by said output count signal, said memory having a corresponding output terminal for each control signal, and wherein the memory is programmed with data defining the desired state of each control signal for each pixel location.

15. Apparatus for display of raster scan imagery signals in relocatable windows on a raster scan video display monitor, comprising:

means for providing digital raster scan imagery window input data defining sequential frames of images to be displayed in said window on said monitor;

a raster scan display monitor comprising display refresh means for periodically raster scanning said display surface to refresh the displayed imagery;

the window input data frame rate being asynchronous with respect to the monitor display refresh rate;

a processor comprising means for providing window definition signals determining the size and location of said window in relation to a monitor display frame;

apparatus responsive to said window definition signals for buffering the input window data to synchronize said data with the display refresh rate and thereby avoid discernible display anomalies, said apparatus comprising:

a display memory buffer comprising means for storing digital image frame data representing the raster imagery data defining a complete image frame on said display monitor;

means for reading out said digital image data stored in said display memory buffer to control said display raster, said reading operation occurring at the vertical rate establishing a "display active" of time invertal said monitor, and being repeated at the display refresh rate;

a window update buffer memory comprising means for storing the window input digital data;

means for loading said window input data comprising a frame of said window data into said update buffer memory; and means for copying the contents of the update buffer memory into said display buffer at locations corresponding to the window location determined by said window definition signals, said copying operation of one frame being completed within a "copy active" time interval which is no longer than the "display active" time interval of said display monitor.

16. The apparatus of claim 15 further comprising video output circuitry coupled to said means for reading out said digital image and responsive to said digital image data for providing raster scan signals compatible with the raster scan operating circuitry of said display monitor.

17. The apparatus of claim 15 wherein said copying means comprises means for transferring data from the update buffer to the display buffer at a vertical rate synchronous with the display refresh rate.

18. The apparatus of claim 15 wherein the input vertical rate of said input window data is slower than said display refresh vertical rate, and wherein said copying means is adapted to commence said copying operation prior to commencement of loading a new frame of window data into said window update buffer memory, whereby the frame of window input data currently stored in said window update buffer memory is copied into said display refresh memory without interference with the new frame of window input data being loaded into said window update buffer memory.

19. The apparatus of claim 15 wherein the input vertical rate of said input window data is faster than said display refresh rate, and wherein said copying means is adapted to commence said copying operation after commencement of loading a new frame of window data into said window update buffer memory, whereby the loading of a complete new frame of window input is performed without interference with said copying operation.

20. The apparatus of claim 15 wherein said processor further comprises means for generating a first signal indicating that the input window vertical rate is slower than the display refresh vertical rate and means for generating a second signal indicating that the input window vertical rate is faster than the display refresh rate, and wherein said buffering means further comprises means responsive to said first signals for commencing said copying operation prior to commencement of loading a new frame of window data into said window update memory, and means responsive to said second signal for delaying commencement of said copying operation until after commencement of loading a new frame window data into said window update memory.

21. The apparatus of claim 15 wherein said buffering apparatus comprises a serial first-in-first-out data buffer for receiving said window input data and thereafter transferring said data to said window update buffer memory.

22. The apparatus of claim 15 wherein said copying means comprises means for transferring successive lines of said window input data frame from said update memory buffer at substantially the vertical rate at which successive lines comprising a displayed frame are scanned by said display monitor.

23. The apparatus of claim 15 wherein said means for providing window input data comprises an analog image data source for providing analog image data and a means for converting said analog image data into corresponding digital image data.

24. The apparatus of claim 15 wherein said means for providing window input data comprises a digital processor.

25. The apparatus of claim 15 wherein said buffering apparatus further comprises a synchronization signal generator for generating plurality of digital control signals controlling the operation of the elements of said buffering apparatus, said generator comprising a counter for providing a unique output count signal corresponding to each pixel location in a raster line, and a digital memory addressed by said output count signal, said memory having a corresponding output terminal for each control signal, and wherein the memory is programmable with data defining the desired state of each control signal for each pixel location.

26. Apparatus for display of raster scan imagery signals in relocatable windows on a raster scan video display monitor, comprising:

means for providing digital raster scan imagery window input data defining sequential frames of dynamically variable images to be displayed in said window on said monitor;

a raster scan display monitor, comprising means for raster-scanning a display surface by raster scanned lines, said display comprising display refresh means for periodically raster scanning said display surface to refresh the displayed imagery, the raster-scanning means comprising blanking means for blanking the display during horizontal blanking intervals between lines, and during vertical blanking intervals between frames of displayed data;

the window input data frame rate being asynchronous with respect to the monitor display refresh rate;

a controller comprising means for providing window definition signals determining the size and location of said window in relation to a monitor display frame;

a dual memory digital frame buffer apparatus for buffering the input window data to synchronize reception of said data with the display refresh rate and thereby avoid discernible display anomalies, said apparatus responsive to said window definition signals and comprising:

a display memory buffer comprising means for storing image frame data representing the predetermined number of lines of raster imagery data defining a complete image frame on said display monitor;

means for sequentially reading out the lines of said digital image data stored in said display memory buffer to control said display raster, said reading operation occurring at the vertical rate of said monitor and being repeated at the display refresh rate;

a window update buffer memory comprising means for storing the window input digital data;

means for loading said window input data comprising a frame of said window data into said update buffer memory; and means activated after each frame of window input data has been loaded into said update buffer memory for copying the contents of the update buffer memory into said display buffer at locations corresponding to the window location determined by said window definition signals, said copying operation of one frame being completed within a "copy active" time interval which is no longer than the "display active" time interval of said display monitor; and video output circuitry coupled to said frame buffer apparatus for processing said display frame data signal to provide raster scan signals compatible with the raster scan operating circuitry of said display monitor.

27. The apparatus of claim 26 wherein said copying means comprises means for transferring data from the update buffer to the display buffer at a vertical rate synchronous with the display refresh rate.

28. The apparatus of claim 26 wherein said buffer apparatus comprises a serial first-in first-out data buffer for receiving said window input data and thereafter transferring said data to said window update buffer memory.

29. The apparatus of claim 26 wherein said copying means comprises means for transferring successive lines of said window input data frame from said update memory buffer at substantially the vertical rate at which successive lines comprising a displayed frame are scanned by said display monitor.

30. The apparatus of claim 26 wherein said means for providing window input data comprises an analog image data source for providing analog image data and a means for converting said analog image data into corresponding digital image data.

31. The apparatus of claim 26 wherein said means for providing window input data comprises a digital processor.

32. The apparatus of claim 26 wherein said buffer apparatus further comprises a synchronization signal generator for generating plurality of digital control signals controlling the operation of the elements of said buffer apparatus, said generator comprising a counter for providing a unique output count signal corresponding to each pixel location in a raster line, and a digital memory addressed by said output count signal, said memory having a corresponding output terminal for each control signal, and wherein the memory is programmed with data defining the desired state of each control signal for each pixel location.

33. Apparatus for display of raster scan imagery signals in relocatable windows on a raster scan video display monitor on which the displayed imagery is periodically refreshed at the display refresh rate, the window input data defining sequential frames of images at a window input frame rate which is asynchronous with respect to the monitor display refresh rate, said apparatus comprising:

a processor comprising means for providing window definition signals determining the size and location of said window in relation to a monitor display frame, and means for generating a first signal indicating that the input window vertical rate is slower than the display refresh vertical rate, and means for generating a second signal indicating that the input window vertical rate is faster than the display refresh vertical rate; and apparatus responsive to said window definition signals for buffering the input window data to synchronize said data with the display refresh rate and thereby avoid discernible display anomalies, comprising:

a display memory buffer comprising means for storing image frame data representing the predetermined number of lines of raster imagery data defining a complete image frame on said display monitor;

means for reading said image frame data in said display memory buffer to control said display raster, said reading operation occurring at the vertical rate establishing a "display active" time interval of said monitor and being repeated at the display refresh rate;

a window update buffer memory comprising means for storing a frame of the window input digital data;

means for loading said window input data comprising a frame of said window data into said update buffer memory; and means for copying the contents of the update buffer memory into said display buffer at locations corresponding to the window location determined by said window definition signals, said copying operation of one frame being completed within a "copy active" time interval which is no longer than the "display active" time interval of said display monitor;

means responsive to said first signal for commencing said copying operation prior to commencement of loading a new frame of window data into said window update memory; and means responsive to said second signal for delaying commencement of said copying operation until after commencement of loading a new frame window data into said window update memory.

* * * * *

UNITED STATES PATENT AND TRADEMARK OFFICE

CERTIFICATE OF CORRECTION

PATENT NO. : 4,961,071

DATED : October 2, 1990

INVENTOR(S) : John R. Krooss

It is certified that error appears in the above-identified patent and that said Letters Patent is hereby corrected as shown below:

Abstract, line 7, delete "greater" and insert in lieu thereof --less--; at line 11, delete "less" and insert "greater".

Column 2, line 4, delete "greater" and insert in lieu thereof --less--; line 23, delete "less" and insert in lieu thereof --greater--.

Column 7, line 39, delete "EXTVBLANK" and insert in lieu thereof --EXTVSYNC--;

Column 10, line 38, delete "Y" and insert in lieu thereof --X--; delete "132" and insert in lieu thereof --121--.

Column 11, line 1, insert --this-- after "During"; line 4, delete "116" and insert in lieu thereof --161--; at line 20 delete "display memory".

Column 15, line 14, delete "of time invertal" and insert in lieu thereof --time interval of--.

UNITED STATES PATENT AND TRADEMARK OFFICE

CERTIFICATE OF CORRECTION

PATENT NO. : 4,961,071

DATED : October 2, 1990

INVENTOR(S) : John R. Krooss

It is certified that error appears in the above-indentified patent and that said Letters Patent is hereby corrected as shown below:

On drawing sheet,

FIG. 6, add a lead line and reference numeral --125-- leading to the block labeled "UPDATE BASE Y REGISTER."

Signed and Sealed this

Eighth Day of November, 1994

Bruce Lehman

*Attest:*

BRUCE LEHMAN

*Attesting Officer*

*Commissioner of Patents and Trademarks*